US010787874B2

(12) United States Patent
Cooper

(10) Patent No.: US 10,787,874 B2
(45) Date of Patent: Sep. 29, 2020

(54) APPARATUS, SYSTEMS AND METHODS FOR MITIGATING SOLIDS ACCUMULATION WITHIN THE WELLBORE DURING STIMULATION OF SUBTERRANEAN FORMATIONS

(71) Applicant: NCS Multistage Inc., Calgary (CA)

(72) Inventor: Kurt Cooper, Houston, TX (US)

(73) Assignee: NCS Multistage Inc., Calgary (CA)

( * ) Notice: Subject to any disclaimer, the term of this patent is extended or adjusted under 35 U.S.C. 154(b) by 0 days.

(21) Appl. No.: 15/982,678

(22) Filed: May 17, 2018

(65) Prior Publication Data

US 2018/0334871 A1 Nov. 22, 2018

Related U.S. Application Data

(60) Provisional application No. 62/507,905, filed on May 18, 2017.

(51) Int. Cl.

| | |
|---|---|
| ***E21B 28/00*** | (2006.01) |
| ***E21B 34/06*** | (2006.01) |
| ***E21B 34/12*** | (2006.01) |
| ***E21B 43/267*** | (2006.01) |

(52) U.S. Cl.

CPC ..... *E21B 28/00* (2013.01); *E21B 34/06* (2013.01); *E21B 34/12* (2013.01); *E21B 43/267* (2013.01); *E21B 2200/06* (2020.05)

(58) Field of Classification Search

CPC ..... E21B 28/00; E21B 34/06; E21B 34/12; E21B 43/267

See application file for complete search history.

(56) References Cited

U.S. PATENT DOCUMENTS

| | | | | |
|---|---|---|---|---|
| 6,705,396 | B1 * | 3/2004 | Ivannikov | E21B 7/18 166/177.6 |
| 6,907,927 | B2 * | 6/2005 | Zheng | E21B 4/18 166/177.6 |
| 7,770,638 | B2 * | 8/2010 | Kabishcher | E21B 28/00 166/177.6 |
| 8,082,989 | B2 * | 12/2011 | Kabishcher | E21B 21/003 166/249 |
| 10,174,600 | B2 * | 1/2019 | Livescu | E21B 43/25 |
| 2010/0212901 | A1 * | 8/2010 | Buytaert | E21B 7/24 166/286 |
| 2011/0259593 | A1 * | 10/2011 | Kostrov | E21B 28/00 166/308.1 |
| 2013/0146281 | A1 * | 6/2013 | Noui-Mehidi | E21B 43/26 166/249 |
| 2014/0131045 | A1 * | 5/2014 | Loiseau | E21B 43/119 166/305.1 |
| 2015/0159447 | A1 * | 6/2015 | Miller | E21B 28/00 166/381 |
| 2017/0016296 | A1 * | 1/2017 | Larsen | E21B 28/00 |
| 2017/0016305 | A1 * | 1/2017 | Prieur | E21B 33/134 |

* cited by examiner

*Primary Examiner* — Matthew R Buck
(74) *Attorney, Agent, or Firm* — Ridout and Maybee LLP

(57) ABSTRACT

There is provided a process for stimulating hydrocarbon production from a subterranean formation, comprising: conducting stimulation material to the subterranean formation via a wellbore, wherein the stimulation material includes solid particulate material; within the wellbore, agitating the conducted stimulation material with a fluid motion-actuating tool, such as, for example, a coiled tubing agitator tool.

15 Claims, 3 Drawing Sheets

APPARATUS, SYSTEMS AND METHODS FOR MITIGATING SOLIDS ACCUMULATION WITHIN THE WELLBORE DURING STIMULATION OF SUBTERRANEAN FORMATIONS

CROSS-REFERENCE TO RELATED APPLICATION

This application claims the benefits of priority from U.S. Provisional Patent Application No. 62/507,905 filed on May 18, 2017 entitled "APPARATUS, SYSTEMS AND METHODS FOR MITIGATING SOLIDS ACCUMULATION DURING STIMULATION OF SUBTERRANEAN FORMATIONS". The entire contents of the priority application is incorporated herein by reference.

FIELD

The present disclosure relates to processes for apparatuses, systems and methods for stimulating hydrocarbon production.

BACKGROUND

When proppant and other solids are not sufficiently suspended in fluid during fracturing, settling of solids around the coiled tubing can occur, particularly in the lateral section of horizontal wellbores. Sand bedding creates increased drag and friction when trying to move the coiled tubing downhole. The increased friction results in having to pump fluid down the annulus to move the coiled tubing within the wellbore, adding excessive time to operations, and increased cost in wellbore load fluid requirements.

SUMMARY

In one aspect, there is provided a process for conducting a slurry through a wellbore comprising, within the wellbore, while the conducting is being effected, agitating the conducted slurry with a fluid motion-actuating tool.

In another aspect, there is provided a process for conducting a slurry through a wellbore comprising, within the wellbore, while the conducting is being effected, agitating the conducted slurry. The agitation is with effect that the agitated slurry, being conducted through the wellbore, is characterized by a Reynolds number of at least 4000.

BRIEF DESCRIPTION OF DRAWINGS

The preferred embodiments will now be described with the following accompanying drawings, in which.

DETAILED DESCRIPTION

Figure 1:
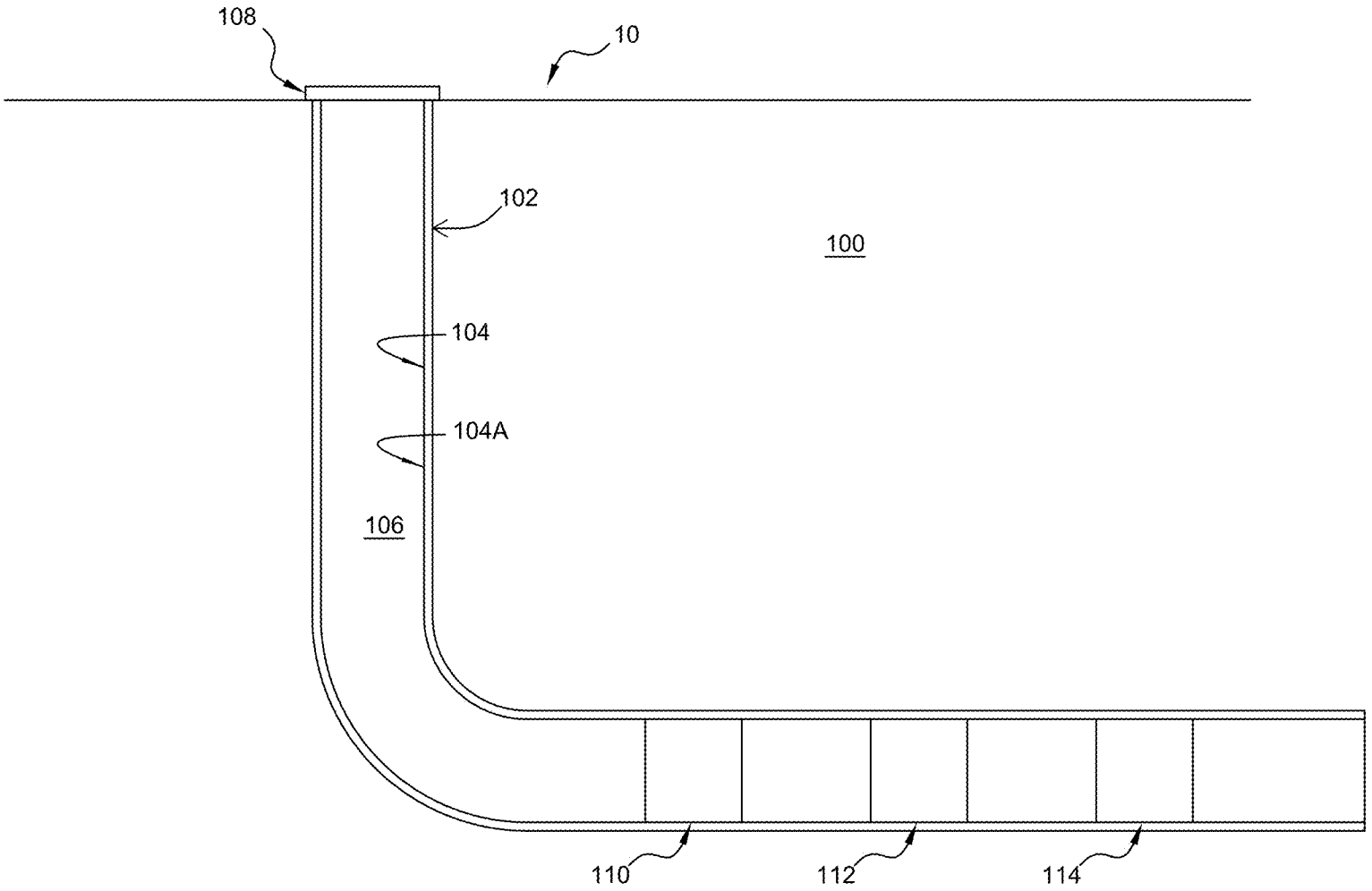
FIG. 1 is a schematic illustration of a system for effecting fluid communication between the surface and a subterranean formation via a wellbore.

Referring to FIG. 1, there is provided a wellbore material transfer system 10 for conducting material from the surface 10 to a subterranean formation 100 via a wellbore 102, from the subterranean formation 100 to the surface 10 via the wellbore 102, or between the surface 10 and the subterranean formation 100 via the wellbore 102. In some embodiments, for example, the subterranean formation 100 is a hydrocarbon material-containing reservoir.

The wellbore 102 can be straight, curved, or branched. The wellbore 102 can have various wellbore sections. A wellbore section is an axial length of a wellbore 102. A wellbore section can be characterized as "vertical" or "horizontal" even though the actual axial orientation can vary from true vertical or true horizontal, and even though the axial path can tend to "corkscrew" or otherwise vary. The term "horizontal", when used to describe a wellbore section, refers to a horizontal or highly deviated wellbore section as understood in the art, such as, for example, a wellbore section having a longitudinal axis that is between 70 and 110 degrees from vertical.

The wellbore 102 is provided for conducting reservoir fluid from the subterranean formation 100 to the surface 10. In some embodiments, for example, the wellbore 102 is provided for conducting stimulation material from the surface 10 to the subterranean formation 100 for stimulating the subterranean formation 100 for production of the reservoir fluid.

In some embodiments, for example, the conducting (such as, for example, by flowing) stimulation material to the subterranean formation 100 via the wellbore 102 is for effecting selective stimulation of the subterranean formation 100, such as a subterranean formation 100 including a hydrocarbon material-containing reservoir. The stimulation is effected by supplying the stimulation material to the subterranean formation 100. In some embodiments, for example, the stimulation material includes a liquid, such as a liquid including water. In some embodiments, for example, the liquid includes water and chemical additives. In other embodiments, for example, the stimulation material is a slurry including water and solid particulate matter, such as proppant. In some embodiments, for example the stimulation material includes chemical additives. Exemplary chemical additives include acids, sodium chloride, polyacrylamide, ethylene glycol, borate salts, sodium and potassium carbonates, glutaraldehyde, guar gum and other water soluble gels, citric acid, and isopropanol. In some embodiments, for example, the stimulation material is supplied to effect hydraulic fracturing of the reservoir.

In some embodiments, for example, with respect to stimulation material that is a slurry that includes solid particulate material (such as proppant), the concentration of solid particulate material within the slurry is between 1 pounds per gallon of the stimulation material to 8 pounds per gallon of the stimulation material.

In some embodiments, for example, the size of the solid particulate material is between 2360-106 Micron.

In some embodiments, for example, the size of the solid particulate material is from 8 mesh to 140 mesh.

In some embodiments, for example, the conducting of fluid, to and from the wellhead, is effected by a wellbore string 104. The wellbore string 104 may include pipe, casing, or liner, and may also include various forms of tubular segments. The wellbore string 104 includes a wellbore string passage 106.

In some embodiments, for example, the wellbore 102 includes a cased-hole completion, in which case, the wellbore string 104 includes a casing 104A.

A cased-hole completion involves running casing down into the wellbore 102 through the production zone. The casing 104A at least contributes to the stabilization of the subterranean formation 100 after the wellbore 102 has been completed, by at least contributing to the prevention of the collapse of the subterranean formation 100 that is defining the wellbore 102. In some embodiments, for example, the casing 104A includes one or more successively deployed concentric casing strings, each one of which is positioned within the wellbore 102, having one end extending from the well head 108. In this respect, the casing strings are typically run back up to the surface. In some embodiments, for example, each casing string includes a plurality of jointed segments of pipe. The jointed segments of pipe typically have threaded connections.

The annular region between the deployed casing 104A and the subterranean formation 100 may be filled with zonal isolation material for effecting zonal isolation. The zonal isolation material is disposed between the casing 104A and the subterranean formation 100 for the purpose of effecting isolation, or substantial isolation, of one or more zones of the subterranean formation from fluids disposed in another zone of the subterranean formation. Such fluids include formation fluid being produced from another zone of the subterranean formation 100 (in some embodiments, for example, such formation fluid being flowed through a production string disposed within and extending through the casing 104A to the surface), or injected stimulation material. In this respect, in some embodiments, for example, the zonal isolation material is provided for effecting sealing, or substantial sealing, of flow communication between one or more zones of the subterranean formation and one or more other zones of the subterranean formation via space between the casing 104A and the subterranean formation 100. By effecting the sealing, or substantial sealing, of such flow communication, isolation, or substantial isolation, of one or more zones of the subterranean formation 100, from another subterranean zone (such as a producing formation), via space between the casing 104A and the subterranean formation 100, is achieved. Such isolation or substantial isolation is desirable, for example, for mitigating contamination of a water table within the subterranean formation by the formation fluids (e.g. oil, gas, salt water, or combinations thereof) being produced, or the above-described injected fluids.

In some embodiments, for example, the zonal isolation material is disposed as a sheath within an annular region between the casing 104A and the subterranean formation 100. In some embodiments, for example, the zonal isolation material is bonded to both of the casing 104A and the subterranean formation 100. In some embodiments, for example, the zonal isolation material also provides one or more of the following functions: (a) strengthens and reinforces the structural integrity of the wellbore, (b) prevents, or substantially prevents, produced formation fluids of one zone from being diluted by water from other zones. (c) mitigates corrosion of the casing 104A, and (d) at least contributes to the support of the casing 104A. The zonal isolation material is introduced to the space (e.g. annular region) between the casing 104A and the subterranean formation 100 after the subject casing 104A has been run into the wellbore 102. In some embodiments, for example, the zonal isolation material includes cement.

For wells that are used for producing reservoir fluid, few of these actually produce through wellbore casing. This is because producing fluids can corrode steel or form undesirable deposits (for example, scales, asphaltenes or paraffin waxes) and the larger diameter can make flow unstable. In this respect, a production string is usually installed inside the last casing string. The production string extends towards the toe of the well and conducts reservoir fluid, received within the wellbore, to the wellhead 108. In some embodiments, for example, the annular region between the last casing string and the production tubing string may be sealed at the bottom by a packer.

In some embodiments, for example, the conduction of fluids between the surface 10 and the subterranean formation 100 is effected via the passage 106 of the wellbore string 104.

In some embodiments, for example, the conducting of the stimulation material to the subterranean formation 100 from the surface 10 via the wellbore 102, or of hydrocarbon material from the subterranean formation 100 to the surface 10 via the wellbore 102, is effected via one or more flow communication stations (three flow communication stations 110, 112, 114 are illustrated) that are disposed at the interface between the subterranean formation 100 and the wellbore 102. Successive flow communication stations 110, 112, 114 may be spaced from each other along the wellbore 102 such that each one of the flow communication stations 110, 112, 114, independently, is positioned adjacent a zone or interval of the subterranean formation 100 for effecting flow communication between the wellbore 102 and the zone (or interval).

For effecting the flow communication, each one of the flow communication stations 110, 112, 114 includes a subterranean formation flow communicator 210 through which the conducting of the material is effected.

In some embodiments, for example, the subterranean formation flow communicator 210 is disposed within an apparatus that has been integrated within the wellbore string 104, and is pre-existing, in that the subterranean formation flow communicator 210 exists before the apparatus, along with the wellbore string 104, has been installed downhole within the wellbore 102. In this respect, each one of the flow communication stations 110, 112, 114, independently, includes a flow control apparatus 200.

Figure 2:
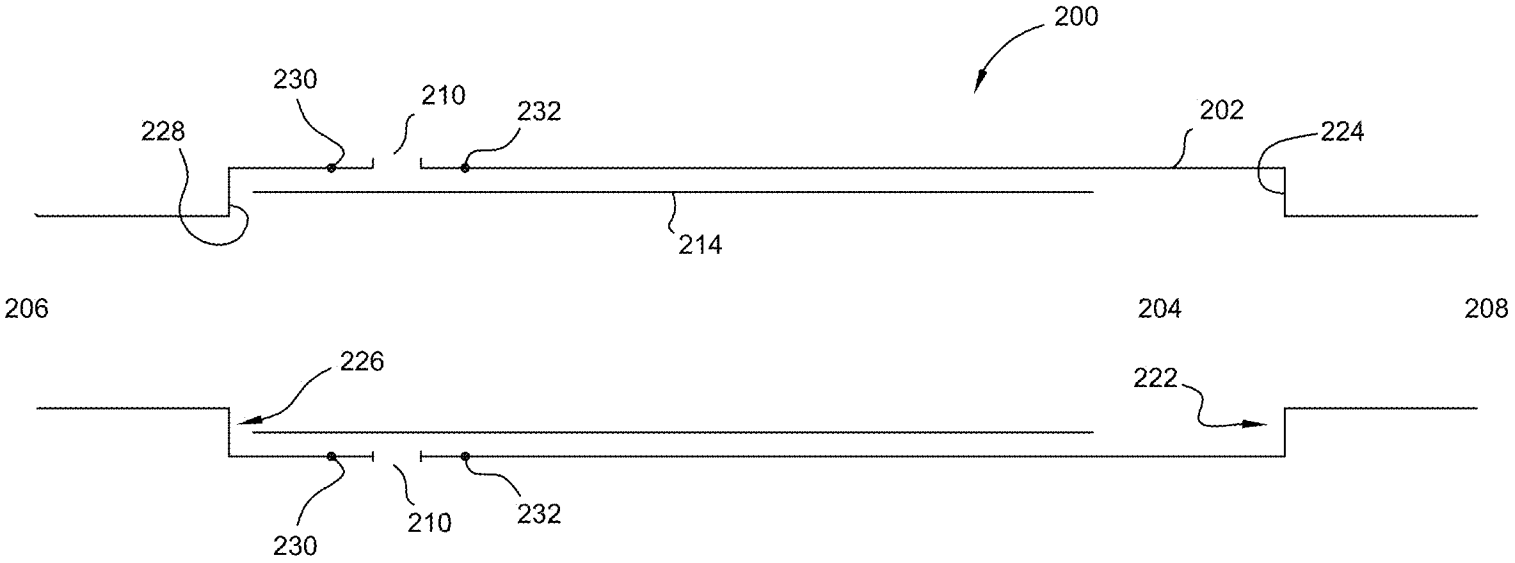
FIG. 2 is a schematic illustration of a flow control apparatus that is useable with the system of FIG. 1.

Referring to FIG. 2, the flow control apparatus 200 includes a housing 202. The housing 202 includes a housing passage 204 with open ends 206, 208. The flow control apparatus 200 is configured for integration within the wellbore string 104 such that the wellbore string passage 106 includes the passage 204. The integration may be effected, for example, by way of threading or welding. In some embodiments, for example, the integration is by threaded coupling, and, in this respect, in some embodiments, for example, each one of the uphole and downhole ends 206, 208, independently, is configured for such threaded coupling to other portions of the wellbore string 104.

The subterranean formation flow communicator 210 extending through the housing 202 of the flow control apparatus 200. In some embodiments, for example, the subterranean formation flow communicator 210 is in the form of one or more ports (not show in the figures). The flow control apparatus 200 further includes a flow control member 214 configured for controlling flow of material, via the subterranean formation flow communicator 210, between the passage 204 and an environment external to the flow control apparatus. In this respect, the flow control member 214 is configured for controlling the material flow through the subterranean formation flow communicator 210.

The flow control member 214 is for opening and closing the flow communicator 210. In this respect, the flow control member 214 is displaceable relative to the subterranean formation flow communicator 210. In this respect, in some embodiments, for example, the flow control member 214 is in the form of a sleeve that is slideably disposed within the passage 204. The flow control member 214 and the subterranean formation flow communicator are co-operatively configured such that the flow control member 214 is displaceable relative to the flow communicator 210 for effecting opening and closing of the flow communicator 210.

The flow control apparatus 200 includes an uphole-disposed flow interference effector 230 that is disposed uphole relative to the flow communicator 210 and a downhole-disposed flow interference effector 232 that is disposed downhole relative to the flow communicator 210. In this respect, the uphole-disposed flow interference effector 230 and the downhole-disposed flow interference effector 232 are disposed on either side of the flow communicator 210. In some embodiments, for example, the uphole-disposed flow interference effector 230 includes one or more sealing members (e.g. one or more o-rings), and, in some of these embodiments, for example, each one of the one or more sealing members, independently, is disposed within a respective recess of the housing and in an interference fit relationship relative to the housing 202. In some embodiments, for example, the downhole-disposed flow interference effector 232 includes one or more sealing members (e.g. one or more o-rings), and, in some of these embodiments, for example, each one of the one or more sealing members, independently, is disposed within a respective recess of the housing and in an interference fit relationship relative to the housing 202

In some embodiments, for example, the uphole-disposed flow interference effector 230, the downhole-disposed flow interference effector 232, and the flow control member 214 are co-operatively, configured such that while each one of the uphole-disposed flow interference effector 230 and the downhole-disposed flow interference effector 232, independently, is disposed in contact engagement with the flow control member 214, the flow communicator 210 is disposed in the closed condition. While the flow communicator 210 is disposed in the closed condition, the flow control member 214 is aligned with the flow communicator 210 with effect that the flow communicator 210 is occluded. In some of these embodiments, for example, the contact engagement between the uphole-disposed flow interference effector 230 and the flow control member 214 is a sealing, or substantially sealing, engagement such that an uphole-disposed sealed interface is established, and the contact engagement between the downhole-disposed flow interference effector 232 and the flow control member 214 is a sealing, or substantially sealing, engagement, with effect that a downhole-disposed sealed interface is established. In this respect, in some embodiments, for example, while the flow communicator 210 is disposed in the closed condition, and each one of the uphole-disposed flow interference effector 230 and the downhole-disposed flow interference effector 232, independently, is disposed in a sealing, or substantially sealing, engagement with the flow control member 214 such that the uphole-disposed sealed interface and the downhole-disposed sealed interface are established, flow communication, via the flow communicator 210, between the housing passage 204 and the environment external to the housing 202, is sealed or substantially sealed.

In some embodiments, for example, the uphole-disposed flow interference effector 230, the downhole-disposed flow interference effector 232, and the flow control member 214 are further co-operatively, configured such that, while the flow control member 214 is disposed relative to the flow communicator 210 such that the flow communicator 210 is disposed in an open condition:

(i) there is an absence of contact engagement between the uphole-disposed flow interference effector 230 and the flow control member 214; and (ii) less than the entirety of the flow communicator 210 is occluded by the flow control member 214 (in some of these embodiment, for example, there is an absence, or substantial absence of occlusion of any portion, or substantially any portion, of the flow communicator 210).

In some embodiments, for example, the uphole-disposed flow interference effector 230, the downhole-disposed flow interference effector 232, and the flow control member 214 are further co-operatively, configured such that, while the flow control member 214 is disposed relative to the flow communicator 210 such that the flow communicator 210 is disposed in an open condition, there is an absence of an uphole-disposed sealed interface with effect that flow communication, between the housing passage 204 and the flow communicator 210 is established.

In some embodiments, for example, while the flow control apparatus 200 is being run-in-hole, the flow control member 214 is releasably retained relative to the housing by one or more frangible interlocking members (such as, for example, one or more shear pins). In some of these embodiments, for example, while releasably secured relative to the housing 202, the flow control member 214 is disposed relative to the flow communicator 210 such that the flow communicator 210 is disposed in the closed condition.

In such embodiments, both of: (i) release of the flow control member 214 from the releasable retention relative to the housing 202, and, upon such release, (ii) displacement of the flow control member 214 relative to the subterranean formation flow communicator 210, is effectible in response to urging of displacement of the flow control member 214, relative to the subterranean formation flow communicator 210, in a first direction (in the illustrated embodiments, this is the downhole direction). In some embodiments, for example, a stop (in the illustrated embodiment, this is the downhole-disposed stop 222) is provided for limiting the displacement of the flow control member 214 such that, when the flow control member 214 becomes engaged to the stop 222, further displacement of the flow control member 214, remotely from the flow communicator 210 (in the illustrated embodiment, this is in the downhole direction), is prevented or substantially prevented, with effect that the flow control member becomes disposed relative to the flow communicator 210 such that the flow communicator is disposed in the open condition. In some embodiments, for example, the downhole-disposed stop 222 is defined by a shoulder 224 defined by the housing 202.

In some embodiments, for example, after the flow control member 214 has been released and displaced in a first direction such that the flow control member 214 becomes engaged to the stop 222, displacement of the flow control member 214 can be urged in an opposite direction to that of the first direction (in the illustrated embodiment, this is the uphole direction) with effect that the flow control member 214 becomes disposed relative to the subterranean formation flow communicator 210 such that, once again, the flow control member 214 becomes disposed relative to the subterranean formation flow communicator 210 such that the subterranean formation flow communicator 210 is disposed in the closed condition.

For effecting opening of the subterranean formation flow communicator 210 so as to enable a stimulation operation (such as, for example, hydraulic fracturing) to be performed, release of the first flow control member 214 from retention relative to the housing 202 (retention by the frangible interlocking members) is effected by a force in a downhole direction (such as, for example, in response to fluid pressure that is translated via a shifting tool while the shifting tool is disposed in gripping engagement with the first flow control member 214). Once released from the retention, the first flow control member 214 can be displaced relative to the subterranean formation flow communicator 210 in a first direction (in the illustrated embodiment, this is the downhole direction) such that the flow control member 214 becomes disposed in abutting engagement with the downhole-disposed stop 222. As a result of this displacement of the flow control member 214, contact engagement between the flow control member 214 and at least the uphole-disposed flow interference effector 230 is defeated such that the subterranean formation flow communicator 210 becomes disposed in the open condition (i.e. the subterranean formation flow communicator 210 is no longer occluded by the flow control member 214).

After the opening of the subterranean formation flow communicator 210, stimulation material can be injected from the surface and into the subterranean formation 100 via the wellbore 102 and the opened subterranean formation flow communicator 210 over a time interval of at least 20 minutes, such as, for example, at least one hour, such as, for example, at least 12 hours, such as, for example, at least 24 hours. After sufficient injecting, the first flow control member 214 is displaced in a direction opposite to the first direction (in the illustrated embodiment, this is the uphole direction) such that flow control member 214 becomes disposed in contact engagement with both of the uphole-disposed flow interference effector 230 and the downhole-disposed flow interference effector 232, and also, in parallel, aligned with the flow communicator 110, thereby occluding the subterranean formation flow communicator 210, with effect that the flow communicator 210 becomes disposed in the re-closed condition. This is so as to permit the injected stimulation material sufficient time to effect the desired stimulation and to permit the subterranean formation with sufficient time to heal. The displacement of the flow control member 214, relative to the housing 202, for effecting the re-closing of the flow communicator 210 can be effected by applying a pulling up force to a shifting tool that is disposed in gripping engagement with the flow control member 214.

In some embodiments, for example, the disposition of the flow control member 214 relative to the housing 202 such the flow communicator 210 is disposed in the re-closed condition, is established in response to abutting engagement with an uphole-disposed stop 226 by the flow control member 214. In some embodiments, for example, the uphole-disposed stop 226 is defined by a shoulder 228 defined by the housing 202.

In some embodiments, for example, after sufficient time has elapsed for effecting the desired stimulation and allowing the formation sufficient time to heal, the flow control member 214 is displaced, once again, relative to the subterranean formation flow communicator 210 (such as, for example, in the downhole direction, such as by fluid pressure applied to a shifting tool that is gripping the first flow control member 214), such that the subterranean formation flow communicator 210 is re-opened, and production of hydrocarbon material from the subterranean formation 100 and into the wellbore 102, via the flow communicator 210, is effectible. In some embodiments, for example, the producing of the hydrocarbon material, via the wellbore 102, is effected over a time interval of at least one (1) hour, such as, for example, at least two (2) hours, such as, for example, at least three (3) hours. Once production is completed, the flow control member 214 can be displaced, once again, relative to the flow communicator 210 for effecting re-closing of the flow communicator 210.

In some embodiments, for example, the subterranean formation flow communicator 210 is defined by perforations within the wellbore string 104, and the perforations are created after the wellbore string 104 has been installed within the wellbore string 104, such as by a perforating gun. In some embodiments, for example, such perforations are defined by slots within pre-slotted liners.

Figure 3:
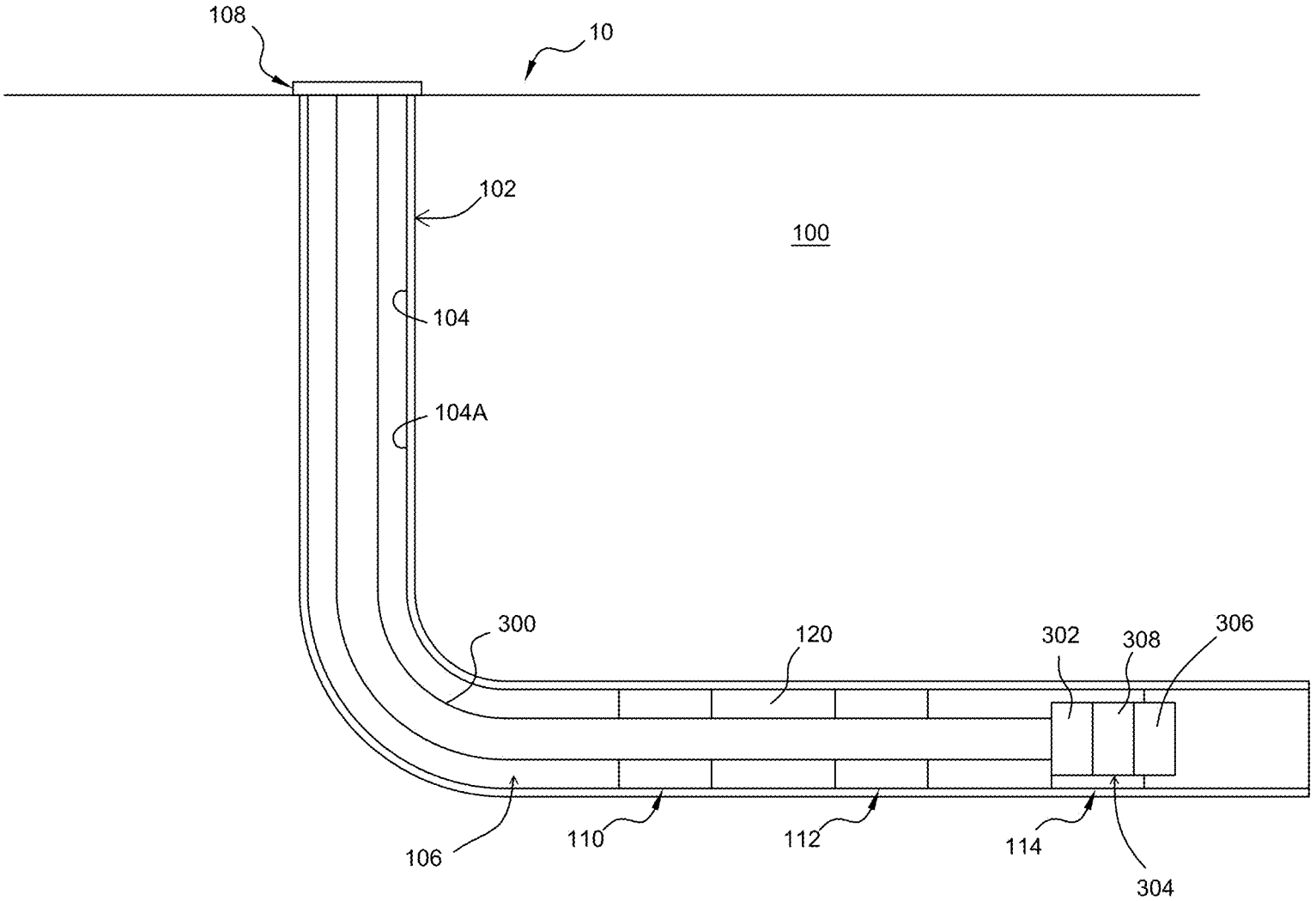
FIG. 3 is a schematic illustration of the system of FIG. 1, with a bottomhole assembly, including a fluid motion-actuating tool, having been deployed within the wellbore.

Referring to FIG. 3, in some embodiments, for example, while the conducting of stimulation material to the subterranean formation 100 from the surface 10 via the wellbore 102 is being effected, the conducted stimulation material is agitated by a fluid motion-actuating tool 302 that is disposed within the wellbore 102. The agitation is with effect that at least a fraction of the solid particulate material, of the stimulation material being conducted through the wellbore 102, remains fluidized within the wellbore 102, and with effect that settling of such solid particulate material, within the wellbore 102, is mitigated. In some embodiments, for example, the agitation is with effect that the stimulation material is characterized by a Reynolds number of at least 4000, such as, for example, at least 4,500, such as, for example, at least 5,000.

In some embodiments, for example, the fluid motion-actuating tool 302 is disposed within a horizontal section of the wellbore 102. In some embodiments, for example, the fluid motion-actuating tool 302 is coupled to a workstring 300 that is disposed within the wellbore 102. In some embodiments, for example, the workstring 300 is conveyable within the wellbore 102. In some embodiments, for example, the workstring 300 includes a coiled tubing string, and the fluid motion-actuating tool 302 is attached to the coiled tubing string, such as by a threaded connection.

In some embodiments, for example, the fluid motion-actuating tool is actuated for effecting the agitation in response to conducting of actuation fluid through the workstring 300. In this respect, the fluid motion-actuating tool is responsive to actuating fluid being conducted through the workstring 300. The actuating fluid includes a liquid, such as, for example, water. In some embodiments, for example, the actuating fluid is conducted through the workstring 300 at a rate of flow of at least two (2) barrels per minute.

In some embodiments, for example, the agitation is effected directly by the fluid motion-actuating tool 302.

In some embodiments, for example, the agitation of the supplied stimulation material is effected indirectly by the fluid motion-actuating tool 302, such as via the workstring 300. In this respect, in some embodiments, for example, the fluid motion-actuating tool 302 actuates movement of the workstring 300, and the movement of the workstring 300 agitates the supplied stimulation material. In some embodiments, for example, the movement of the workstring 300, actuated by the fluid motion-actuating tool 302, includes a vibrational movement.

In some embodiments, for example, the fluid motion-actuating tool 302 includes a spring/mass oscillator, such as, for example, a hydraulically-assisted spring/mass oscillator. In some embodiments, for example, the fluid motion-actuating tool 302 includes a waterhammer valve. In some embodiments, for example, the fluid motion-actuating tool 302 includes a static mixer.

In some embodiments, for example, the fluid motion-actuating tool 302 includes a coiled tubing agitator tool. Suitable examples of coiled tubing agitator tools include the Agitator™ NEO CT Tool, available from National Oilwell Varco, Inc., and HydroPull™ Extended Reach Tool available from Tempress Technologies, a division of Oil States Energy Services, Inc. In some embodiments, for example, the coiled tubing agitator tool is threaded to the coiled tubing. In some embodiments, for example, the coiled tubing agitator tool is part of a bottomhole assembly that is coupled to coiled tubing.

In some embodiments, for example, the stimulation material is conducted within a space 120 between the workstring 300 and the wellbore string 104. In some embodiments, for example, the space 120 between the workstring 300 and the wellbore string 104 is an annular space.

In some embodiments, for example, the agitating is effected within a wellbore space that is disposed: (i) within a cross-section of horizontal section 102A of the wellbore 102 where the central longitudinal axis of the workstring 300 is disposed below the central longitudinal axis of the wellbore 102, and (ii) below the workstring 300.

In some embodiments, for example, the agitating is effected within a wellbore space that is disposed: (i) within a cross-section of a horizontal section of the wellbore 102 where the central longitudinal axis of the workstring 300 is disposed closer to the lowermost portion of the wellbore 102 than to the uppermost portion of the wellbore 102, and (ii) below the workstring 300.

In some embodiments, for example, the agitating is effected at a total measured depth of at least 13,000 feet (such as, for example, at least 14,000 feet, such as, for example, at least 15,000 feet, such as, for example, at least 16,000 feet, such as, for example, at least 17,000 feet). In this respect, in some embodiments, for example, the agitating is effected while the fluid motion-actuating tool 302 is disposed at a total measured depth of at least 13,000 feet (such as, for example, at least 14,000 feet, such as, for example, at least 15,000 feet, such as, for example, at least 16,000 feet, such as, for example, at least 17,000 feet).

In some embodiments, for example, the workstring 300 includes a bottomhole assembly 304. In some embodiments, for example, the bottomhole assembly 304 includes one or more downhole tools. In some embodiments, for example, the bottomhole assembly 304 includes a deployable packer 306 for sealingly engaging, or substantially sealingly engaging, the casing 104AA. In those embodiments where the flow communication stations 110, 112, 114 include a flow control apparatus for effecting the supplying of the stimulation material to the subterranean formation 100, in some of these embodiments, for example, the bottomhole assembly 304 includes a shifting tool 308 configured for displacing the flow control member 214 relative to the flow communicator 210 such that the opening of the flow communicator 210 is effected, or a shifting tool 308 configured for displacing the flow control member 214 relative to the flow communicator 210 such that closing of the flow communicator 210 is effected.

The agitating is effected while the stimulation material is being supplied to the subterranean formation 100 via the flow communicator 210 of the flow control apparatus 200 of the flow communication station 110 (112, 114). In those embodiments where the flow communication station 110 (112, 114) includes a flow control apparatus 200 for effecting the supplying of the stimulation material to the subterranean formation, in some of these embodiments, for example, prior to the supplying of the stimulation material to the subterranean formation 100 via the flow communication station 110 (112, 114), the flow control member 214 is displaced relative to the flow communicator 210 such that the opening of the flow communicator 210 is effected for establishing fluid communication between the wellbore 102 and the subterranean formation 100 via the flow communicator 210. In some embodiments, for example, the displacement of the flow control member 214 for effecting opening of the flow communicator 210 is effected by the shifting tool 308 of the bottomhole assembly 304. In some embodiments, for example, the shifting tool includes actuatable and actuated position, and the shifting tool 308 is operative to effect the displacement of the flow control member 214 while the shifting tool 308 is disposed in the actuated position and is engaged to the flow control member 214.

In some embodiments, for example, while the supplying of the stimulation material is being effected, the packer 306 of the bottomhole assembly 304 is disposed such that a sealed interface is established for preventing, or substantially preventing, conduction of the supplied stimulation material, downhole relative to the flow communication station 110 (112, 114). In some embodiments, for example, the disposition of the packer 306 is with effect that bypassing of the opened flow communicator 210, by the supplied stimulation material, is prevented or substantially prevented.

In some embodiments, for example, after the supplying of the stimulation material to the subterranean formation via the flow communication station 110 (112, 114) has been effected (such supplying being effected while the agitating is being effected) for a time interval (such as, for example, at least 30 minutes, such as, for example, at least one hour, such as, for example, at least 12 hours, such as, for example at least 24 hours), the workstring 300 is displaced within the wellbore 102. In some embodiments, for example, the displacement is with effect that the workstring 300 becomes removed from the wellbore 102. In some of these embodiments, for example, the displacement is effected by a coiled tubing injector. In some embodiments, for example, the effected displacement is along a longitudinal axis of the wellbore 102.

In some embodiments, for example, after the supplying of the stimulation material to the subterranean formation via the flow communication station 110 (112, 114) has been effected (such supplying being effected while the agitating is being effected) for a time interval (such as, for example, at least 30 minutes, such as, for example, at least one hour, such as, for example, at least 12 hours, such as, for example at least 24 hours), the workstring 300 is displaced (such as, for example, in an uphole direction) within the wellbore 102 with effect that the bottomhole assembly 304 becomes re-positioned within the wellbore 102. In some embodiments, for example, the bottomhole assembly 304 is disposed at a total measured depth of at least 13,000 feet (such as, for example, at least 14,000 feet, such as, for example, at least 15,000 feet, such as, for example, at least 16,000 feet, such as, for example, at least 17,000 feet) while the displacement is being effected. In some of these embodiments, for example, the displacement is effected by a coiled tubing injector. In some embodiments, for example, the effected displacement is along a longitudinal axis of the wellbore 102. In some of these embodiments, for example, the displacement is an uphole displacement. In some of these embodiments, for example, the displacement is a downhole displacement. In those embodiments where the displacement is a downhole displacement, in some of these embodiments, for example, the displacement of the workstring 300 is effected in the absence, or substantial absence, of urging by fluid material within the space between the workstring 300 and the wellbore string 104 (i.e. in the absence, or substantial absence, of any assistance from fluid pressure within the space between the workstring 300 and the wellbore string 104). Also in those embodiments where the displacement is a downhole displacement, in some of these embodiments, for example, the displacement of the workstring 300 includes that which is effected in response to urging by displacement-actuating fluid material being conducted downhole within a space between the workstring and the subterranean formation, and the flow rate of the displacement-actuating fluid material is less than five (5) barrels per minute, such as, for example, less than four (4) barrels per minute, such as, for example, less than three (3) barrels per minute, such as, for example, less than two (2) barrels per minute, such as, for example, less than one (1) barrel per minute, In those embodiments where the bottomhole assembly 304 includes a packer 306, in some of these embodiments, for example, prior to the re-positioning, the packer 306 is retracted from the wellbore string 104. In some embodiments, for example, after the bottomhole assembly 304 is re-positioned, the packer 306 of the bottomhole assembly 304 is re-deployed such that a sealed interface is established for preventing, or substantially preventing, conduction of the supplied stimulation material, downhole relative to the flow communicator 210 of another one of the flow communication stations 115, 215, 315. In some embodiments, for example, the re-deployment of the packer 306 is with effect that bypassing of the opened flow communicator 210 of the another one of the flow communication stations 115, 215, 315 by the supplied stimulation material, is prevented or substantially prevented.

In some embodiments, for example, the re-positioning of the bottomhole assembly 304 is with effect that the shifting tool 308 becomes disposed for effecting opening of the flow control member 214 of the flow control apparatus 200 of the another one of the flow communication stations 115, 215, 315 (for example, the shifting tool 308 becomes aligned with the flow control member 214).

In some embodiments, for example, the bottomhole assembly 304 becomes re-positioned after the supplying of the stimulation material to the subterranean formation, via the flow communication station 110 (112, 114). In those embodiments where the flow communication station 110 (112, 114) includes the flow control apparatus 200, in some of those embodiments where the bottomhole assembly 304 becomes re-positioned after the supplying of the stimulation material to the subterranean formation, via the flow communication station 110 (112, 114), has been suspended, for example, the suspension of the supplying is effected after displacement of the flow control member 214 by the shifting tool 308 of the bottomhole assembly 304, with effect that the flow communicator 210 becomes disposed in the closed condition.

In some of these embodiments, for example, such as during extended reach applications, the re-positioning of the bottomhole assembly 304 is effected in response to a displacement of the workstring 300 that is effected by the fluid motion-actuating tool 302 in response to conducting of fluid through the workstring 300 (such as, for example, a coiled tubing string). The conducting of fluid through the workstring 300 actuates the fluid motion-actuating tool, with effect that the workstring 300 is displaced along a longitudinal axis of the wellbore. In some embodiments, for example, the conducting of fluid is with effect that flow of the conducted fluid is at a rate of from 1.5 barrels per minute to four (4) barrels per minute It is understood that, in some embodiments, for example, other slurry material, being conducted through the wellbore 102 during other wellbore operations, could also be agitated by the fluid motion-actuating tool 302 for mitigating settling of solid particulate material.

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. All references mentioned are hereby incorporated by reference in their entirety.

The invention claimed is:

1. A process for conducting a slurry through a wellbore of a subterranean formation, comprising:

within the wellbore, while the conducting is being effected, agitating the conducted slurry with a fluid motion-actuating tool;

wherein:

the conducted slurry includes stimulation material;

the conducting includes conducting of the stimulation material to the subterranean formation, with effect that the subterranean formation is stimulated by the stimulation material for producing hydrocarbon material; and the agitation is with effect that the agitated slurry, being conducted through the wellbore, is characterized by a Reynolds number of at least 4000.

2. The process as claimed in claim 1;

wherein the fluid motion-actuating tool is coupled to a workstring that is conveyable within the wellbore.

3. The process as claimed in claim 1;

wherein the agitation is effected within a horizontal section of the wellbore.

4. The process as claimed in claim 1;

wherein the agitating is effected at a total measured depth of at least 13,000 feet.

5. The process as claimed in claim 2;

wherein the slurry is conducted within a space between the workstring and the subterranean formation.

6. The process as claimed in claim 2;

wherein:

the wellbore is lined with a wellbore string; and the slurry is conducted within a space between the workstring and the wellbore string.

7. The process as claimed in claim 2;

wherein:

the agitating is effected in response to movement of the workstring; and the fluid motion-actuating tool actuates movement of the workstring.

8. The process as claimed in claim 5;

wherein the agitation is effected within a horizontal section of the wellbore.

9. The process as claimed in claim 8;

wherein the agitating is effected at a total measured depth of at least 13,000 feet.

10. The process as claimed in claim 7;

wherein the movement of the workstring, actuated by the fluid motion-actuating tool, includes a vibrational movement.

11. The process as claimed in claim 5;

wherein the fluid motion-actuating tool includes a coiled tubing agitator tool.

12. The process as claimed in claim 6, further comprising:

suspending the conducting of the slurry; and displacing the workstring through the wellbore in a downhole direction;

wherein:

the agitating is effected at a total measured depth of at least 13,000 feet;

the displacing is effected in the absence, or substantial absence, of urging by fluid material disposed within a space between the workstring and the wellbore string.

13. The process as claimed in claim 2, further comprising:

suspending the conducting of the slurry; and displacing the workstring through the wellbore in a downhole direction;

wherein:

the agitating is effected at a total measured depth of at least 13,000 feet;

the displacing includes displacing that is effected in response to urging by displacement-actuating fluid material being conducted downhole within a space between the workstring and the subterranean formation; and the flow rate of the displacement-actuating fluid material is less than five (5) barrels per minute.

14. The process as claimed in claim 3;

wherein the agitating is effected at a total measured depth of at least 13,000 feet.

15. The process as claimed in as claimed in claim 1;

wherein:

the conducted slurry includes the stimulation material and solid particulate material; and the conducted slurry is characterized by a concentration of solid particulate material between 1 pounds per gallon of the stimulation material to 8 pounds per gallon of the stimulation material.

* * * * *